US010408593B1

(12) United States Patent
Blazek et al.

(10) Patent No.: US 10,408,593 B1
(45) Date of Patent: Sep. 10, 2019

(54) VENTED TORQUE RELEASE DEVICE IN A FUZE WELL

(71) Applicant: The United States of America, as Represented by the Secretary of the Navy, Arlington, VA (US)

(72) Inventors: Benjamin M. Blazek, Ridgecrest, CA (US); Lee R. Hardt, Ridgecrest, CA (US); Carl A. Weinstein, Ridgecrest, CA (US)

(73) Assignee: The United States of America, as Represented by the Secretary of the Navy, Washington, DC (US)

( * ) Notice: Subject to any disclaimer, the term of this patent is extended or adjusted under 35 U.S.C. 154(b) by 19 days.

(21) Appl. No.: 15/891,237

(22) Filed: Feb. 7, 2018

(51) Int. Cl.
*F42B 39/20* (2006.01)
*F42C 19/02* (2006.01)
*F42B 12/20* (2006.01)

(52) U.S. Cl.
CPC ..... *F42B 39/20* (2013.01); *F42B 12/207* (2013.01); *F42C 19/02* (2013.01)

(58) Field of Classification Search
CPC ..... F42B 39/20; F42B 39/14; F42B 33/0278; F42C 19/02
USPC ..... 102/481
See application file for complete search history.

(56) References Cited

U.S. PATENT DOCUMENTS

| | | | | |
|---|---|---|---|---|
| 4,991,513 A * | 2/1991 | Malamas | F42B 39/20 | 102/293 |
| 5,035,181 A * | 7/1991 | Jacks | F42B 39/20 | 102/293 |
| 5,631,440 A * | 5/1997 | Thureson | C06C 5/04 | 102/275.7 |
| 5,939,662 A * | 8/1999 | Bootes | F42B 12/06 | 102/473 |
| 6,227,119 B1 * | 5/2001 | Schmacker | F42B 25/00 | 102/473 |
| 6,523,477 B1 * | 2/2003 | Brooks | F42B 30/003 | 102/481 |
| 2003/0033954 A1 * | 2/2003 | Brooks | F42B 30/003 | 102/481 |

* cited by examiner

*Primary Examiner* — Jonathan C Weber
(74) *Attorney, Agent, or Firm* — James M. Saunders

(57) ABSTRACT

Embodiments are directed to a vented torque release device including hollow fuze well having a proximal end, a distal end, an inner surface, and an outer surface. A wall is defined by the inner surface and the outer surface. A plurality of vents are axially spaced at equal distance about the outer surface.

5 Claims, 5 Drawing Sheets

VENTED TORQUE RELEASE DEVICE IN A FUZE WELL

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD

Embodiments generally relate to insensitive munitions and shock mitigation.

Figure 1:
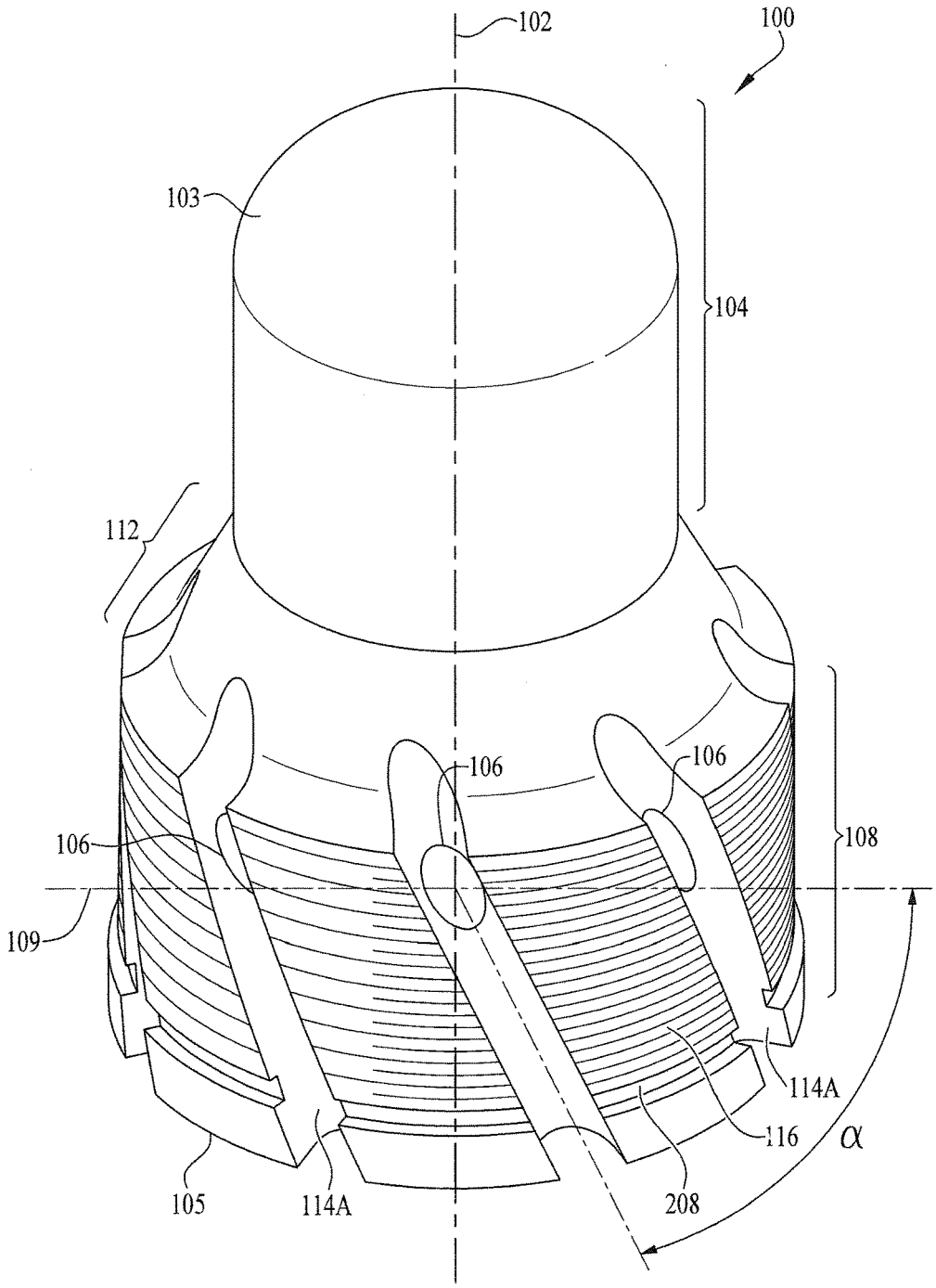
FIG. 1 is a perspective view of a vented torque release mechanism having a plurality of grooves, according to some embodiments.

It is to be understood that the foregoing general description and the following detailed description are exemplary and explanatory only and are not to be viewed as being restrictive of the embodiments, as claimed. Further advantages will be apparent after a review of the following detailed description of the disclosed embodiments, which are illustrated schematically in the accompanying drawings and in the appended claims.

DETAILED DESCRIPTION OF EMBODIMENTS

Embodiments may be understood more readily by reference in the following detailed description taking in connection with the accompanying figures and examples. It is understood that embodiments are not limited to the specific devices, methods, conditions or parameters described and/or shown herein, and that the terminology used herein is for the purpose of describing particular embodiments by way of example only and is not intended to be limiting of the claimed embodiments. Also, as used in the specification and appended claims, the singular forms "a," "an," and "the" include the plural.

Embodiments generally relate to insensitive munitions (IM) improvements and shock mitigation improvements. Current IM release methods have limited secondary vent areas and rely on the increasing pressure and heat of reaction to fail the attachment interface and eject the fuze and or fuze well. Embodiments solve this problem by offering additional secondary vent paths having unique geometrical configurations that assist in the removal of attachment interfaces, fuzes, and fuze wells using non-failure techniques. Embodiments also improve fuze survivability by reducing shocks transmitted to the fuze. Embodiments are also used to restrain smaller diameter parts within a larger diameter shell or case.

Some embodiments are referred to as a releasable erosion enhancing mechanism (REEM) having unique venting features. The embodiments allow for variable venting of ignited energetics as well as applying loading to aid in release of the fuze well and fuze by causing a counter torque of the fuze well, enabling an improved munition response to Slow Cook-Off (SCO) and Fast Cook-Off (FCO) Insensitive Munitions Tests.

Additionally, structural features are included that reduce the shock experienced by a munition fuze due to, but not limited to, loads during weapon penetration and pyro-shock. Component orientation provides dampening and results in impedance mismatches across interfaces. This additional dampening, as well as impedance mismatches, results in reduced shock and vibrational pressures and stresses transferred to munition fuzes. Based on this, embodiments are applicable to penetrating and non-penetrating warhead, bomb, and rocket motor families in which a plug or base is desired to provide variable venting and/or release.

Although embodiments are described in considerable detail, including references to certain versions thereof, other versions are possible such as, for example, orienting and/or attaching components in different fashion. Therefore, the spirit and scope of the appended claims should not be limited to the description of versions included herein.

In the accompanying drawings, like reference numbers indicate like elements. Reference characters 100, 200, 250, 300, 418, and 518 are used to depict various embodiments. Several views are presented to depict some, though not all, of the possible orientations of the embodiments. Some figures depict section views and, in some instances, partial section views for ease of viewing. The patterning of the section hatching is for illustrative purposes only to aid in viewing and should not be construed as being limiting or directed to a particular material or materials. Components used in several embodiments, along with their respective reference characters, are depicted in the drawings. Components depicted are dimensioned to be close-fitting and to maintain structural integrity both during storage and while in use.

Insensitive Munitions Embodiments—FIGS. 1, 2A, 3, 4, & 5

Referring to FIG. 1, an embodiment includes a vented torque release device 100. The vented torque release device 100 is a fuze well centered about a central longitudinal axis 102. The central longitudinal axis 102, although depicted in somewhat exaggerated form for ease of viewing, is depicted in all figures to show that it is common to all components and can also be referred to as a common longitudinal axis. The central longitudinal axis 102 is used as a reference feature for orientation. The fuze well 100 can be stainless steel, Silicon Aluminum Metal Matrix Composite, and other erodible metals that will erode and provide greater dampening properties over steel.

The fuze well 100 is hollow and can be referred to as a vented fuze well and vented plug and other similar terminology without detracting from the merits or generalities of the embodiments. The fuze well 100 has a proximal end 103, a distal end 105, an inner surface 115 (FIG. 2A), an outer surface 116, a first outer portion 104, and a second outer portion 108. The proximal end 103 of the fuze well 100 is a hemi-ellipsoidal shape. The outer surface 116 is threaded at the second outer portion 108 and, at times, is referred to as the threaded outer surface. A thread relief 208 is shown at the distal end 105.

The first and second outer portions 104 & 108 are separated by a flared region 112. The first and second outer portions 104 & 108 have corresponding diameters, sometimes referred to as first and second diameters.

The first outer portion 104 is located at the proximal end 103 and the second outer portion 108 is located at the distal end 105. As shown in FIG. 1, the first outer portion's 104 corresponding diameter is smaller than the second outer portion's 108 corresponding diameter. In the embodiments, the flared region 112 transitions from the first outer portion 104 (first diameter) to the second outer portion 108 (second diameter).

Figure 3:
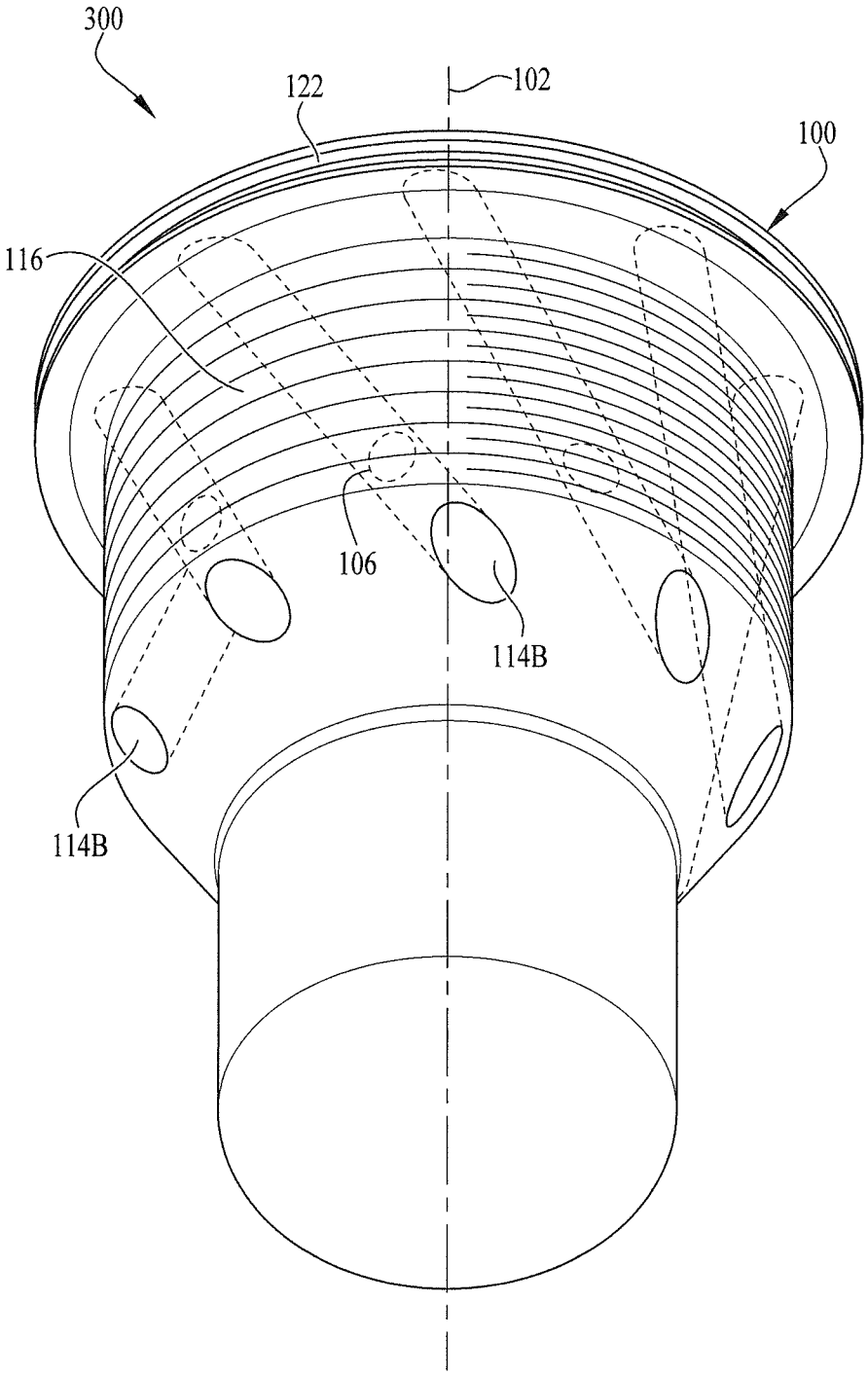
FIG. 3 is a perspective view of a vented torque release mechanism having a plurality of holes, according to some embodiments.

Embodiments employ a plurality of vents, represented by reference characters 114A and 114B, corresponding to a plurality of grooves and a plurality of holes, respectively. The plurality of vents 114A/114B are axially-spaced at equal distance along the outer surface 116. The plurality of vents 114A/114B are grooves (FIG. 1) or holes (FIG. 3). Reference character 114A depicts the plurality of grooves. FIG. 3 shows the embodiment 300 having the plurality of holes 114B. As shown in FIG. 1, the plurality of grooves 114A are axially-spaced at equal distance about the outer surface 116 and span longitudinally from the flared region 112 through the second outer portion 108 to the distal end 105. Due to the geometry of the fuze well 100 depicted in FIG. 1, the plurality of grooves 114A in the flared region 112 have a semi-elliptical shape.

Figure 2A:
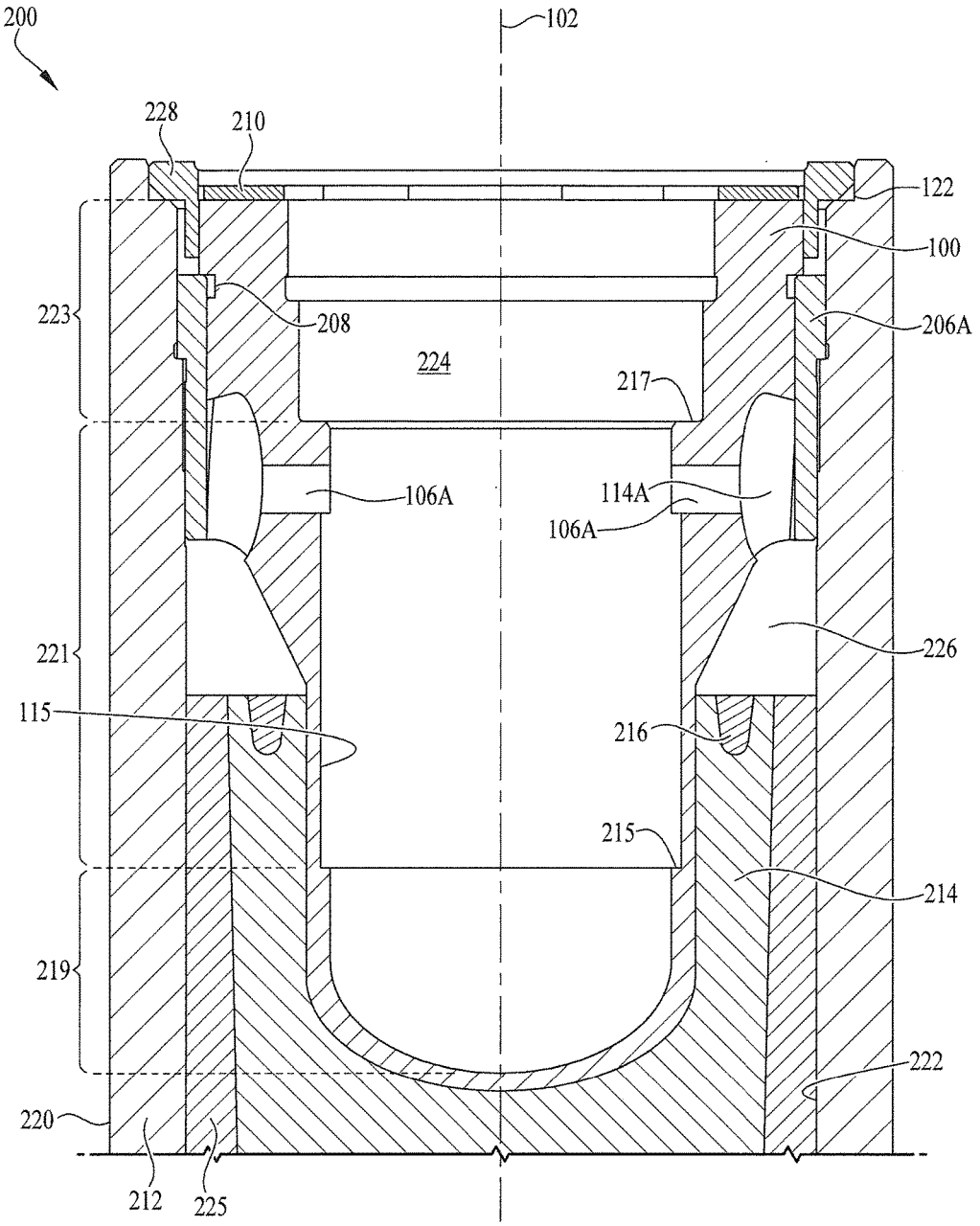
FIG. 2A is a section view of a releasable erosion enhancing mechanism including the vented torque release mechanism shown in FIG. 1 and its orientation environment in the aft end of a munition.

In FIG. 2A, depicted by reference character 200, a section view of the embodiment in FIG. 1 is shown. Due the symmetry of the embodiments, one having ordinary skill in the art will recognize that the cut plane for the section view in FIG. 2A is along the central longitudinal axis 102. The embodiment can be referred to as a releasable erosion enhancing system, a vented fuze well, a releasable fuze well, a cook-off mitigation system, an insensitive munitions system, and similar designations.

A releasable ring 206A, sometimes referred to as a threaded release ring, is concentric about the fuze well 100. The releasable ring 206A is threaded and threads onto the threaded outer surface 116 of the fuze well 100, especially with respect to the third outer portion 108. As shown in FIG. 2A, the releasable ring 206A is concentric about the fuze well 100, spanning from the plurality of grooves 114A to a thread relief 208 in the vented torque relief device.

The proximal end 103 of the fuze well 100 is closed and hemi-ellipsoidal in shape. The distal end 105 of the fuze well 100 is open. A sealing vent cover 210 is attached to the distal end 105 of the fuze well 100. The sealing vent cover 210 has stress riser grooves (not shown for ease of view) along the periphery of the plurality of grooves 114A to ensure proper opening. A munition casing 212, sometimes referred to as munition case, is concentric about the releasable ring 206A. The munition casing 212 is steel and has an outer surface 220 and an inner surface 222. The inner surface 222 is threaded to match threads on the releasable ring 206A. A steel fuze well retaining ring 218 (not shown in FIG. 2A for ease of view but shown in FIG. 2B) assists in securing the fuze well 100 to the munition casing 212. The munition casing 212 is configured to house a main fill energetic 214 and an ignition energetic 216.

The main fill energetic 214 is sometimes referred to as a first energetic and is depicted in FIG. 2A. The proximal end 103 of the fuze well 100 is closed and is at least partially enveloped by the first energetic 214. The ignition energetic 216 is sometimes referred to as a second energetic. The ignition energetic 216 has a lower auto-ignition temperature than the main fill energetic 214.

The inner surface 222 of the munition casing 212 is lined with an interior liner 225. The interior liner 225 can be either a protective liner or a reactive liner separating the munition casing 212 from the first energetic 214. Suitable protective liner materials include asphaltic hot melt, wax coating, and plastic.

As depicted in FIG. 2A, an ullage space 226 is an open space/void defined by the flared region 112, the plurality of grooves 114A, the releasable ring 206A, the inner surface 222 of the munition case 212, the reactive liner 225, the main fill energetic 214, and the ignition energetic 216. A synthetic felt pad or an adhesive sealant layer can be used in some munitions to provide ullage space, but it is not needed in all munitions, and is not shown in the figures for ease of view. The ignition energetic 216 is housed inside the munition case 212 and adjacent to the ullage space 226. Internally, a fuze envelope 224 is depicted as open space inside the fuze well 100 in FIG. 2A. The fuze envelope 224 is configured to house the munition fuze (not shown for ease of viewing).

The spacing of the plurality of grooves or holes 114A/114B is based on the burning rate of the first energetic 214. The plurality of grooves or holes 114A/114B are equally spaced axially about the circumference of the second outer portion's 108 threaded outer surface 116, as well as part of the flared region 112. The number of grooves or holes 114A/114B is a range of about four to about twelve.

In the embodiment depicted in FIG. 1, the plurality grooves 114A are a plurality of helical grooves having a cant range of about 30 degrees to about 60 degrees (depicted by angle $\alpha$ in FIG. 1) as measured from a plane 109 orthogonal to the central longitudinal axis 102. The embodiments in shown in FIGS. 3, 4, and 5 also have a plane orthogonal to the central longitudinal axis 102, however the plane is not shown for ease of view. Thus, for example, in FIG. 3, the plurality of holes 114B have an angular range of about 30 degrees to about 60 degrees from a plane orthogonal to the central longitudinal axis 102, although the angle $\alpha$ is not specifically shown for ease of view.

One having ordinary skill in the art will recognize that the term helical is designating the grooves 114A as being similar to a helix about the fuze well 100. One can envision a helical coil as being representative of the use of the word helical. Additionally, one having ordinary skill in the art will recognize that a cant (canting) is generally defined as an angular deviation from a vertical or horizontal surface or plane, such as an inclination. As such, in the embodiments, a cant is used to define an angular deviation between the helical grooves (114A) and the central longitudinal axis 102. One having ordinary skill in the art will also recognize that the plurality of holes 114B can also be canted.

The embodiments also include additional secondary venting that aids in eroding the fuze well 100 faster, thus releasing the fuze well faster, as well as offering additional shock mitigation benefits. FIGS. 1 and 3 generically depict a plurality of radial apertures 106, which can also be referred to as a plurality of radially located apertures or radial holes. As shown in FIGS. 1 and 3, each groove and hole in the plurality of grooves and plurality of holes 114A & 114B, respectively, has a corresponding radial aperture 106. The plurality of apertures 106 are radially located holes that are co-located with corresponding grooves/holes 114A/114B to provide enhanced fuze booster venting.

Figure 2B:
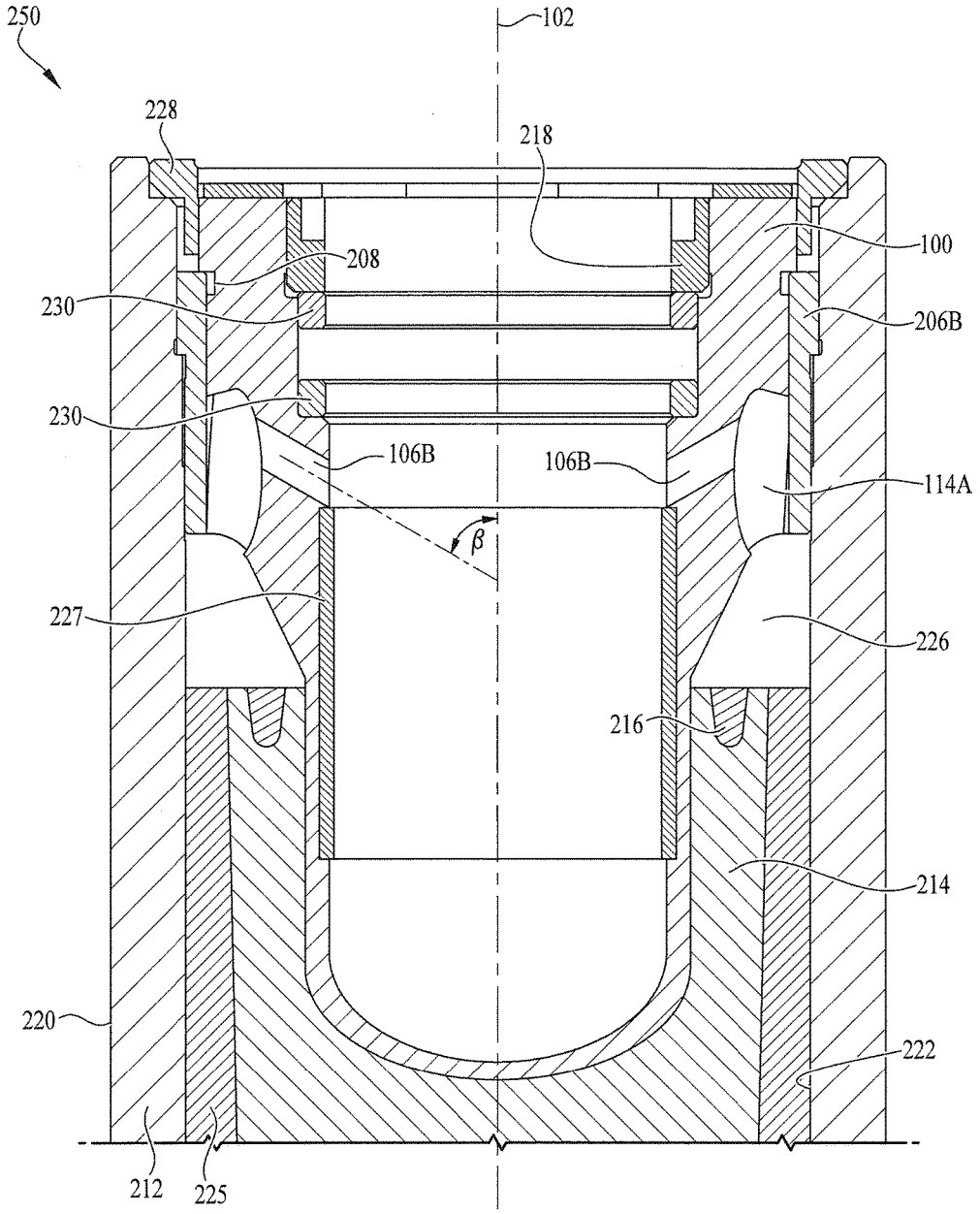
FIG. 2B is a section view of a shock mitigation mechanism including the vented torque release mechanism shown in FIG. 1 in the aft end of a munition.

The plurality of radially-located apertures 106 are angled from about 60 degrees to about 90 degrees from the central longitudinal axis 102 and are oriented to vent expanding internal gases inside the fuze well 100 out toward corresponding grooves or holes 114A/114B. FIGS. 2A and 2B show additional orientations of the radial apertures 106 with reference characters 106A and 106B, respectively. FIG. 2A shows the radial aperture 106A in an orthogonal orientation to the central longitudinal axis 102. Angle β in FIG. 2B depicts the 60 to 90 degrees orientation of the radial apertures 106B in FIG. 2B and specifically shows the radial aperture at less than 90 degrees from the central longitudinal axis 102. It is understood by a person having ordinary skill in the art that β is also present in FIG. 2A and representative of a similar internal angle in FIG. 3, although not shown for ease of view.

The releasable ring 206A is a carbon reinforced polymer. In some embodiments, the releasable ring 206A is about 40 percent carbon fiber, with the remainder being a thermoplastic or thermosoftening plastic such as, for example, polyurethane plastic. In other embodiments, the releasable ring 206A can be a range of about 20 percent to about 60 percent carbon fiber, with a corresponding range of thermoplastic or thermosoftening plastic of about 80 percent to about 40 percent.

The sealing vent cover 210 is made of a weak polymer, such as acrylonitrile butadiene styrene (ABS), which is not reactive, can survive both hot and cold temperatures and does not cause foreign object damage (FOD) to aircraft. ABS will soften at very high temperatures. The sealing vent cover 210 is attached to the fuze well 100 with screws that are configured to melt away, soften, or otherwise release at a temperature similar to the threaded release ring 206A. The screws are sometimes referred to as eutectic screws. The sealing vent cover 210 will either fly off, peel away, or melt, depending on the specific cook-off event. Similarly, a vent cover retaining ring 228 is threaded and assists with attaching the fuze well 100 to the munition case 212 and steel fuze well retaining ring 218. The vent cover retaining ring 228 is made of a structural metal and is configured to release with the fuze well 100 during cook-off events.

Figure 4:
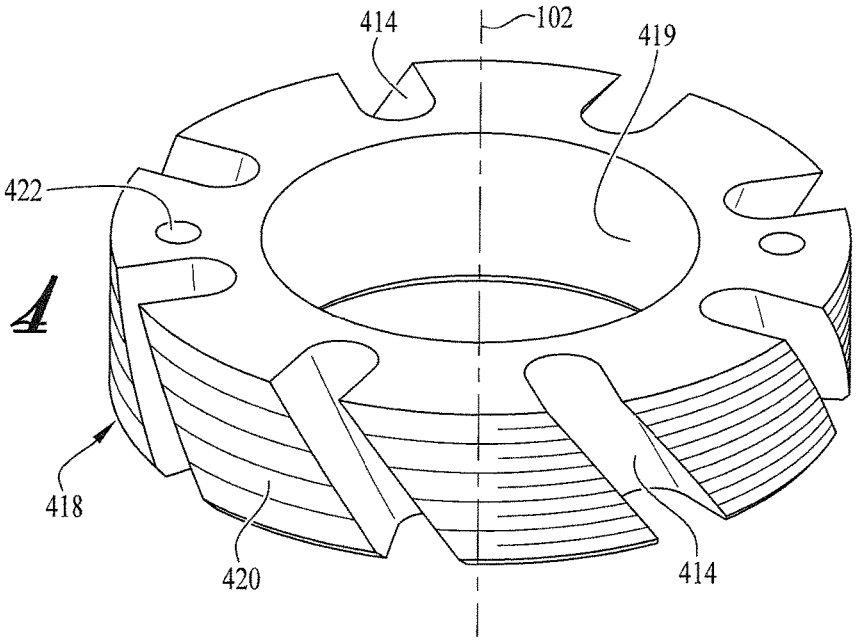
FIG. 4 is a perspective view of a fuze well retaining ring having a plurality of grooves, according to some embodiments.

FIG. 4 shows another embodiment, depicted by reference character 418, showing a vented fuze well retaining ring having an inner surface 419 and a threaded outer surface 420 defining a retaining ring wall. The vented fuze well retaining ring 418 is stainless steel, Silicon Aluminum Metal Matrix Composite, or other erodible metals. The vented fuze well retaining ring 418 functions in lieu of a threaded interface between the steel fuze well and the munition casing. Additionally, the vented fuze well retaining ring 418 can be used with or without a vented fuze well 100, i.e. without the fuze well depicted in FIGS. 1, 2A, 2B, & 3 and referenced with reference characters 100 & 300. When configured in conjunction with an unvented fuze well, the interior of the distal end would have a surface extending radially inward to retain the fuze well, not shown for ease of viewing. Thus, the vented fuze well retaining ring 418 is configured to act upon an unvented fuze well. Diametrically opposed attachment holes 422 are shown to assist with tightening and torqueing the vented fuze well retaining ring 418.

A plurality of vents 414, shown as angled grooves, which can also be referred to as "angled vent grooves" or simply "grooves" are axially spaced about the threaded outer surface 420. The spacing of the plurality of angled vent grooves 414 about the threaded outer surface 420 is based on the burning rate of the first energetic 214. The plurality of angled vent grooves 414 are equally spaced axially about the circumference of the threaded outer surface 420. The number of vents/angled vent grooves 414 is a range of about four to about twelve vents. The angling of the plurality of vents/angled vent grooves 414 is an angle range of about 30 degrees to about 60 degrees, as measured from a plane (not shown for ease of view) orthogonal to the central longitudinal axis 102. When acted upon during cook-off events, the vented fuze well retaining ring 418 provides a counter torque, causing the vented fuze well retaining ring to back out of its associated assembly, and allowing gases and the vented or unvented fuze well to escape.

Figure 5:
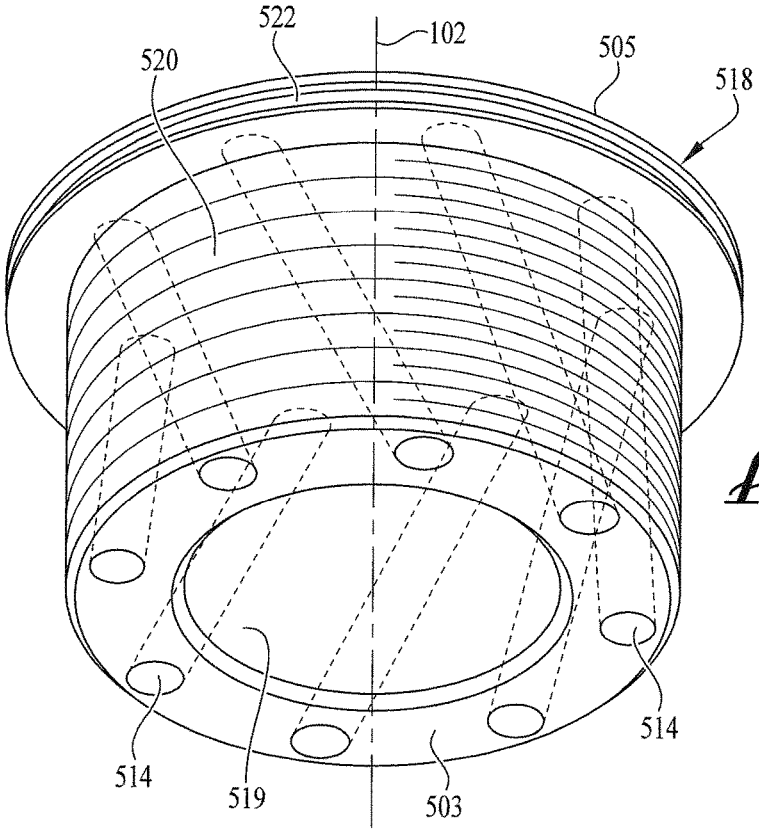
FIG. 5 is a perspective view of a fuze well retaining ring having a plurality of holes, according to some embodiments.

FIG. 5 shows another embodiment, depicted by reference character 518, showing a vented fuze well retaining ring having an inner surface 519 and a threaded outer surface 520 defining a retaining ring wall. The vented fuze well retaining ring 518 has a proximal end 503 and a distal end 505. When configured in conjunction with an unvented fuze well, the interior of the distal end would have a surface extending radially inward to retain the fuze well, not shown for ease of viewing. The distal end 505 is flared outward, away from the threaded outer surface 520. An O-ring groove 522 is shown at the distal end 505 and is configured for an O-ring (not shown for ease of view). The vented fuze well retaining ring 518 is stainless steel, Silicon Aluminum Metal Matrix Composite, or other erodible metals. The vented fuze well retaining ring 518 functions in lieu of the steel fuze well retaining ring shown (depicted with reference character 218 in FIG. 2B). Thus, the vented fuze well retaining ring 518 is configured to act upon a vented or an unvented fuze well.

A plurality of vents 514, shown as angled holes, which can also be referred to as "angled vent holes" or simply "holes" are axially spaced in the vented fuze well retaining ring 518. The vents associated with reference character 514 can also be referred to with the qualifier "plurality." The spacing of the plurality of angled vent holes 514 in the vented fuze well retaining ring 518 is based on the burning rate of the first energetic 214. The plurality of angled vent holes 514 are equally spaced axially in the vented fuze well retaining ring 518 and, specifically, spaced axially in the retaining ring wall defined by the inner and outer surfaces 519 & 520. The number of vents/angled vent holes 514 is a range of about four to about twelve vents. The angling of the plurality of vents/angled vent holes 514 is an angle range of about 30 degrees to about 60 degrees, as measured from a plane (not shown for ease of view) orthogonal to the central longitudinal axis 102. When acted upon during cook-off events, the vented fuze well retaining ring 518 provides a counter torque, causing the vented fuze well retaining ring to back out of its associated assembly, and allowing gases and the vented or unvented fuze well to escape.

Shock Mitigation Embodiments—FIG. 2B

FIG. 2B is depicts a shock mitigation device 250 in the aft end of a munition. FIG. 2A is also relied on for ease of viewing for certain features. Due to the symmetry of the embodiments, one having ordinary skill in the art will recognize that the cut plane for the section view in FIG. 2B is along the central longitudinal axis 102. The shock mitigation device 250 can also be referred to as a pyro shock mitigation device. The shock mitigation device 250 includes the hollow fuze well 100 described above with proximal end 103, distal end 105, inner surface 115, and outer surface 116. The central longitudinal axis 102, unless stated otherwise, is common to all components and is used as a reference feature for orientation. The inner surface 115 of the fuze well 100 defines the fuze envelop 224. The fuze envelope 224 has a first inner portion 219, a second inner portion 221, and third inner portion 223. The first inner portion 219 is located at the proximal end 103. The first inner portion 219 transitions to the second inner portion 221 and the second inner portion transitions to the third inner portion 223. The third inner portion 223 is located at the distal end 105. As shown, the first, second, and third inner portions 219, 221, & 223 are centered about the central longitudinal axis 102.

The second inner portion 221 has a recess 215 for a shock dampening liner 227 that is affixed to the perimeter of the inner surface 115 of the fuze well 100. The shock dampening liner 227 is configured to assist with cushioning the fuze by enveloping the fuze, thereby cushioning fuze electronics from pyro shock waves. The shock dampening liner 227 is a solid material having a density greater than foams but much lower than steel, thus having a lower stiffness, similar to low density polyethylene or high density polyethylene. To ensure low static electricity, the shock dampening liner 227 includes carbon. Suitable examples for the shock dampening liner 227 include a plastic-carbon mix, low density polyethylene mixed with carbon, high density polyethylene mixed with carbon, polyamides (nylon), and polytetrafluoroethylene (PTFE), known by the DuPont brand name Teflon®.

The shock dampening liner 227 is configured with a plurality of channels (not shown for ease of view) to allow expanding gases from the fuze booster to traverse aft to and out the radially located apertures 106A/106B aligned with the plurality of grooves 114A and the plurality of holes 114B to provide fuze booster venting.

At least one shock dampening collar 230, sometimes referred to as a fuze shock isolation ring, or shock isolation ring is shown. The shock isolation ring 230 is a solid material with lower density and sound speed than steel, but with sufficient strength to constrain the fuze and the fuze retaining ring preload. Suitable materials for the shock isolation ring 230 include polymers (plastics) such as delrin acetal homopolymer.

In FIG. 2B, the fuze shock isolation ring 230 is depicted as two collars that are configured to sandwich a locating feature (not shown) of the fuze and are retained by the steel fuze well retaining ring 218. The fuze retaining ring 218 is attached about the perimeter of the third inner portion 223 of the inner surface 115 and securely retains the shock isolation ring 230 and the fuze in place within the fuze envelope 224. The shock isolation ring 230 acts on the fuze by dampening the shock incurred during penetration or a pyroshock event, thus significantly attenuating the shock experienced by the munition fuze.

It is apparent that the recess 215 is a step, or transition, from the first inner portion 219, to the second inner portion 221. Likewise, it is also apparent that the fuze envelop 224 has a step 217, or transition, from the second inner portion 221 to the third inner portion 223. The shock dampening liner 227 spans the longitudinal length of the recess 215.

Another embodiment is shown in FIG. 2B for a pyroshock mitigation system in the aft end of a munition. This embodiment includes a shock dampening ring 206B concentric about the hollow fuze well 100. The shock dampening ring 206B is a carbon reinforced polymer. In some embodiments, the shock dampening ring 206B is about 40 percent carbon fiber, with the remainder being polyurethane plastic or other suitable binder/matrix material. In other embodiments, the shock dampening ring 206B can be a range of about 20 percent to about 60 percent carbon fiber, fiber glass, or aramid reinforcement, with a corresponding polymer binder range of about 80 percent to about 40 percent.

The shock dampening ring 206B is concentric about the fuze well 100. The shock dampening ring 206B is threaded and threads onto the threaded outer surface 116 of the fuze well 100, especially with respect to the second outer portion 108. As shown in FIG. 2B, the shock dampening ring 206B is concentric about the fuze well 100, spanning from the plurality of grooves 114A to a thread relief 208.

Theory of Operation

The releasable ring 206A is threaded onto the fuze well 100 and torqued to specification. Following this, the assembly of the releasable ring 206A and the fuze well 100 are inserted into the inner surface 222 of the munition casing 212 and torqued to specification. The sealing vent cover 210 is then attached to the fuze well 100 with screws which are configured to melt away, soften, or otherwise release at temperature similar to the releasable ring 206A.

The releasable ring 206A melts or thermally softens such that its strength is removed. The fuze well 100 features angled holes 114B and/or canted helical grooves 114A, through which the hot expanding gases traverse. Due to the angled holes 114B or canted helical grooves 114A redirecting the flow a resultant torque is applied in the direction of removal. The canted helical grooves 114A offer greater release area and, thus, provide a less obstructed route for the releasable ring 206A to exude into and be carried away by the expanding gases.

The ignition energetic 216 has a lower self-heating temperature such that it will ignite during an undesired thermal stimulus before the main fill 214 will react. The heat generated by the ignition energetic 216 will initiate the main fill 214 to burn. The ignition energetic 216 is located on the free surface of the main fill 214 in close proximity to the fuze well 100. A person having ordinary skill in the art will recognize that the free surface is the surface of the energetic that is exposed to the ullage space 226. This surface mates against an air volume to provide oxygen for ignition as well as volume for gases that will limit pressure rise. The plurality of grooves 114A allow for more effective and complete drainage of the reactive liner 225 and the melted release ring 206A.

The embodiments redirect the expanding gases produced by ignited energetics to enlarge the vent paths through erosion as well as apply loading counter to assembly torque thereby aiding in release of the fuze well 100 and fuze to enable improved munition response to the Slow Cook-Off and Fast Cook-Off Insensitive Munitions Tests. Vent paths' angle or cant are chosen to adjust the rate of increased erosion as well as torque transferred. Use of increased erosion enables use of smaller vent paths than typically required, to enable use of stronger parts to satisfy penetration survivability and other operational requirements.

The primary vent path is the ejection of the entire fuze well 100. Embodiments offer secondary vent paths which are the plurality of grooves or holes 114A/114B, depicted in the embodiments. Grooves 114A provide more vent area and reduce the interfacial contact area through which shock energy may be transferred compared to typical vent holes 114B. The presence of the secondary vent path grooves 114B provide adjacent volume for exuding, melted or otherwise softened releasable retaining ring 206A or similar mechanism to flow, thereby solving issues pertaining to the typical releasable mechanism causing vent and/or release obstructions.

The reduced interface due to the grooves 114A can also be constructed to further reduce shock energy transmitted to the fuze due to, but not limited to, loads during weapon penetration and pyro-shock. The torque applied through gas redirection facilitates release of the fuze well 100 in a more consistent and gradual process with less pressure and thereby less abuse experienced by the fuze. As such, embodiments offer many positive aspects, including: shock dampening, vent paths to prevent pressure build-up and violent release, releasable fuze well 100 to maximize vent area, maintains penetration survivability/joint strength, auto-ignition material to start mild burning at vent location to preempt energetic run-away, use of venting hot gases to enlarge vent holes as well as assist in release of fuze well 100. Embodiments accomplish this without the negative aspects of: pent-up pressure release in violent events, compromised joint strength to enable fuze well release, permanent joints preventing disassembly for maintenance or assessment, single point of failure vent paths, energetic main fill auto-ignition at undesired location.

The redirection of hot gas flow through the plurality of grooves or holes 114A/114B increases the amount and rate of erosion on the inner walls of the vents. This erosion by removing material from the inner surfaces of the vent path increases the effective vent area. Typically the burn rate increases during a cook-off event, thus more vent area is required later in a cook-off. This erosion allows for a more optimal design as it increases the vent area during the event. Venting is increased further with fuze well 100 release.

The shock dampening ring 206B is made from a material of lower stiffness and thus more dampening properties than typical metal parts. The lower stiffness and density results in an impedance mismatch across the interfaces. This additional dampening, as well as impedance mismatch, results in reduced shock and vibrational pressures and stresses transferred to the fuze. Thus, the energy experienced by the shock dampening ring 206B, especially the portion adjacent to the plurality of grooves 114A, is not transferred to the fuze well 100 or fuze because the shock dampening ring flexes in the free space area inside the groove. The plurality of grooves 114A or plurality of holes 114B also reduces the area across which shocks can be transmitted, further reducing the shock transmitted to the fuze.

The second energetic/ignition energetic 216, is either an explosive or propellant and is chosen such that it has a lower self-heating temperature than the first energetic/main fill 214. The second energetic/ignition energetic 216 is placed near the plurality of grooves 114A or holes 114B. The second energetic 216 has an annular form, sometimes referred to as a ring-shape, of sufficient size and so dimensioned to be tolerant of exudation during FCO/SCO environment ensuring sufficient second energetic material remains within the munition to provide ignition. When the second energetic/ignition energetic 216 reacts, it ignites the first energetic/main fill 214 and causes it to burn, producing gases that escape out of the plurality of grooves 114A or holes 114B, which prevents pressure buildup. The quantity of second energetic/ignition energetic 216 is small in relation to the quantity of the first energetic/main fill 214. The second energetic/ignition energetic 216 is a different explosive/propellant, although it may be a main fill type, than the first energetic/main fill 214, which allows less parasitic mass and volume compared to existing configurations.

While the embodiments have been described, disclosed, illustrated and shown in various terms of certain embodiments or modifications which it has presumed in practice, the scope of the embodiments is not intended to be, nor should it be deemed to be, limited thereby and such other modifications or embodiments as may be suggested by the teachings herein are particularly reserved especially as they fall within the breadth and scope of the claims here appended.

What is claimed is:

1. A vented torque release device, comprising:

a hollow fuze well having a proximal end, a distal end, an inner surface, an outer surface, and a wall defined by said inner surface and said outer surface, said hollow fuze well centered about a central longitudinal axis;

wherein said outer surface having a first outer portion and a second outer portion, said first outer portion located at said proximal end, said second outer portion located at said distal end, said first and second outer portions separated by a flared region; and a plurality of vents formed as grooves in said outer surface of said second outer portion and said flared region, said plurality of vents axially spaced at equal distance about said second outer portion and said flared region.

2. The device according to claim 1, wherein said first outer portion having a first diameter, said second outer portion having a second diameter, wherein said first diameter is less than said second diameter.

3. The device according to claim 1, wherein said plurality of vents is a plurality of helical grooves axially spaced about said outer surface and spanning longitudinally from said flared region through said second outer portion to said distal end.

4. The device according to claim 1, wherein said outer surface is threaded along said second outer portion.

5. The device according to claim 1, wherein the number of said plurality of vents is a range of about 4 to about 12 vents.

* * * * *